United States Patent [19]

Kemeny

[11] Patent Number: 4,942,686

[45] Date of Patent: Jul. 24, 1990

[54] PORTABLE DISPLAY SYSTEM

[76] Inventor: Matthias D. Kemeny, 1625 SW. Westwood Ct., Portland, Oreg. 97201

[21] Appl. No.: 386,944

[22] Filed: Jul. 31, 1989

Related U.S. Application Data

[63] Continuation-in-part of Ser. No. 226,292, Jul. 29, 1988, Pat. No. 4,888,895.

[51] Int. Cl.[5] ..... G09F 15/00

[52] U.S. Cl. ..... 40/610; 52/109; 52/646

[58] Field of Search ..... 40/610, 605; 52/109, 52/646; 211/202; 160/135

[56] References Cited

U.S. PATENT DOCUMENTS

| | | | |
|---|---|---|---|
| 4,512,097 | 4/1985 | Zeigler | 40/610 |
| 4,658,560 | 4/1987 | Beaulieu | 40/610 |
| 4,663,899 | 5/1987 | Nodskov et al. | 52/109 |
| 4,747,239 | 3/1988 | Zeigler | 52/109 |
| 4,800,663 | 1/1989 | Zeigler | 40/610 |
| 4,809,471 | 3/1989 | Wichman et al. | 52/109 |

*Primary Examiner*—Cary E. Stone

*Attorney, Agent, or Firm*—Kolisch, Hartwell & Dickinson

[57] ABSTRACT

A display system includes a collapsible, rectangular frame having a plurality of rectangular box units. Each box unit includes rectangularly arranged sides which are defined by a pair of arms, joined to one another by a scissor connection. The top and bottom side arms include at least one telescoping member therein. Connector-block nodes are located at each corner of the box units and include pivot means for securing the arms thereto for permitting the frame to be collapsed to a compact form. Plural display supports extend along files of connected block nodes on the front face of the frame, each support extending between adjacent connector block nodes and including a pair of display-support runners. The display-support runners are joined to one another at one, central end thereof by a central hinge and joined to a connector block node at the other end thereof by an end hinge.

24 Claims, 7 Drawing Sheets

PORTABLE DISPLAY SYSTEM

BACKGROUND OF THE INVENTION

This is a continuation-in-part of Serial No. 07/226,292, filed July 29, 1988 for A PORTABLE DISPLAY SYSTEM, now U.S. Pat. No. 4,888,895.

The present invention relates to display systems, and specifically to a portable display system which includes a collapsible frame having display supports thereon which provide a smooth display surface.

A number of display systems are known which are both portable and collapsible. These systems typically include a number of elongate arms attached at their ends to articulation blocks or nodes which allow for the folding of the frame to a collapsed condition. Some of the known systems provide for curvature to be imparted to the frame. Such systems have provided a display capability not previously possible in that they can be constructed to form a full size display which can be collapsed to a compact shape for storage or transport. However, the systems are often complex in construction and therefore expensive. They are also limited in that each system is typically capable of only a single display configuration. Further, the systems do not always provide a smooth display surface, regardless of whether the desired surface is to be flat or curved. Finally, even though the systems are described as portable, they are frequently not capable of easy packing and transporting on commercial, passenger airlines.

It is an object of the present invention to overcome the drawbacks and limitations of the prior art proposals. More specifically, the invention has, as its objects:

(1) to provide a portable display system having a frame which may be disposed in a planar, curved or circular pattern, as desired by the user;

(2) to develop a display system which is less complex and therefore less expensive than existing designs;

(3) to provide a display system with display supports which extend along a face of a frame to provide a smooth display surface;

(4) to provide, on display supports, a mechanism for interlocking multiple frames together along the edges thereof, while providing for a flexible arrangement of frames in a desired configuration.

SUMMARY OF THE INVENTION

The above objects are best achieved by providing a display system which includes a collapsible, rectangular frame having a plurality of rectangular box units. Each box unit includes rectangularly arranged sides which are defined by a pair of arms, joined to one another by a scissor connection. The top and bottom side arms include at least one telescoping member therein. Connector block nodes are located at each corner of the box units and include pivot means for securing the arms thereto for permitting the frame to be collapsed to a compact form. Plural display supports extend along files of connected block nodes on the front face of the frame, each support extending between adjacent connector block nodes and including a pair of display-support runners. The display-support runners are joined to one another at one, central end thereof by a central hinge and joined to a connector block node at the other end thereof by an end hinge.

These and other objects and advantages of the present invention will become more fully apparent as the description which follows is read in conjunction with the drawings.

DETAILED DESCRIPTION OF THE PREFERRED EMBODIMENT

Figure 1:
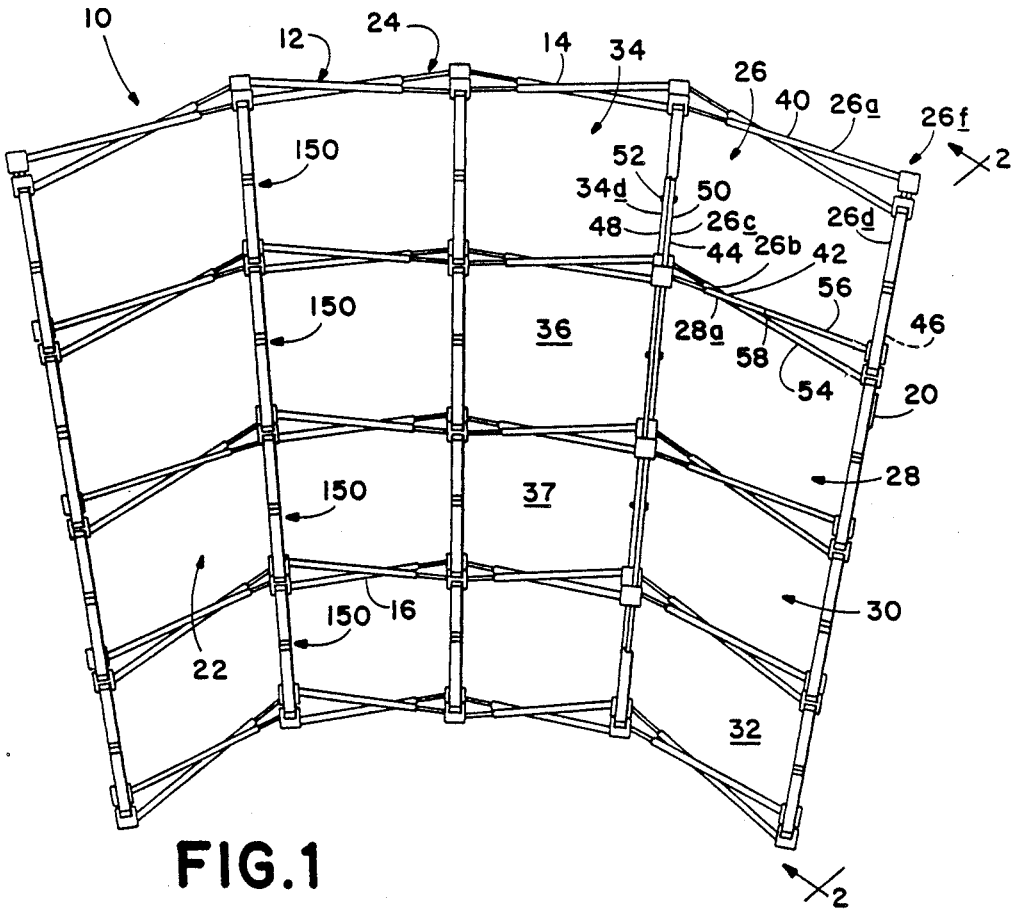
FIG. 1 is a perspective view of the display system of the invention, shown in a curved condition.

Turning now to the drawings, and initially to FIG. 1, the portable display system of the invention is shown generally at 10. System 10 includes a frame 12 which, in the preferred embodiment is generally rectangular and has a top 14, a bottom 16, and opposed, spaced-apart sides including left side 18 and right side 20. A front face 22 is visible in FIG. 1 while a rear face 24 is on the opposite side of the frame.

Frame 12 is made up of a plurality of rectangular box units, such as box units 26, 28, 30, 32, 34, 36, 37 and 38. Eight additional, unnumbered, box units comprise the rest of frame 12.

Each box unit, and now referring to box unit 26, has a top side **26*a*, a bottom side 26*b*, a left side 26*c*, a right side 26*d*, a forward face 26*e* and a rearward face 26*f***.

Figure 6:
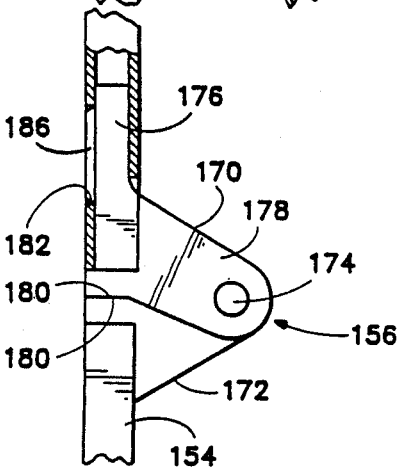
FIG. 6 is a greatly enlarged, fragmentary view of a telescoping member of the invention, with portions broken away to show detail.
Figure 6:
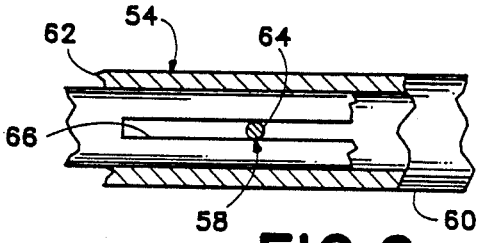

Each of the box unit sides is defined by a pair of arms, such as arm pair 40, 42, on the top and bottom, respectively, and 44, 46, on the left and right sides, respectively. The arm pairs which make up the right and left sides include arms 48, 50 while the arms which make up arm pairs 40, 42 include arms 54, 56 and scissor connection 58. Arms 54, 56 are constructed to telescope, to enable frame 12 to be curved. To this end, each telescoping arm, and now referring to arm 54 in FIGS. 1 and 6, includes a large-diameter element 60 and a small-diameter element 62. Small-diameter element 62 is received within large-diameter element 60. Arm 54 is secured to arm 56 by scissor connection 58 which includes a scissor pin 64. Because the presence of scissor pin 64 would limit the amount of travel of small-diameter element 62 and large-diameter element 60, small-diameter element 62 is provided with a slot 66 which is fittable around pin 64 and allow the small-diameter element to be fully received in a large diameter element.

The provision of telescoping arms 54, 56 allows flexing of frame 12 in either direction, or in an S-curve. The provision of a telescoping mechanism in a single arm of the top and bottom arm pairs enables the frame to be curved in a single direction only. This configuration may be used in special situations, or where it is desirable to produce a less costly display system.

Figure 3:
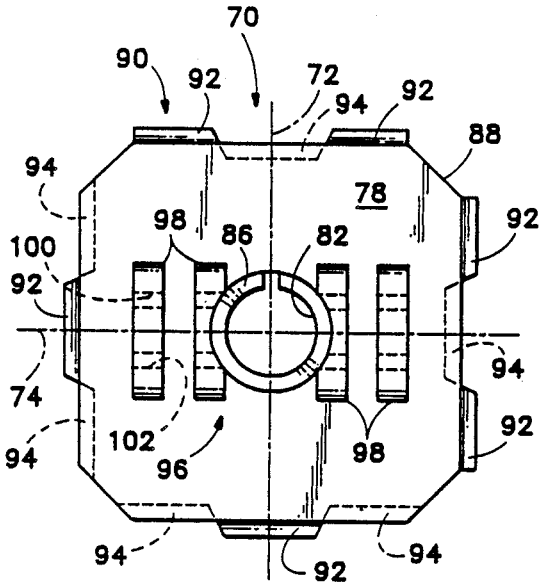
FIG. 3 is a plan view of an exterior surface of a connector block node of the invention.
Figure 4:
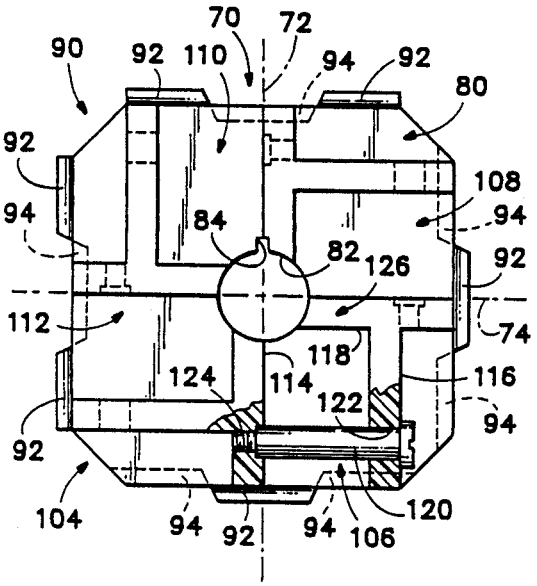
FIG. 4 is a plan view of an interior surface of a connector block node of the invention.

Referring now to FIGS. 3 and 4, a connector-block node of the invention is shown generally at 70. It should be understood that all of the nodes in the frame are identically constructed. A node, such as node 70, is located at each corner of each box unit. Each node includes a vertically disposed axis 72 and a horizontally disposed axis 74. Axes 72 and 74 are perpendicular to one another. A second-horizontal axis 76 extends orthogonally to axes 72, 74.

Each node has an exterior surface 78, which is arranged to face outward from the frame. Each node also includes an interior surface 80 which faces toward the interior of the frame. A bore 82 extends through the node between the exterior and interior surfaces thereof, with the center of the bore being collinear with the second-horizontal, or bore, axis 76. In the preferred embodiment, bore 82 includes a key way or notch 84 located at the upper margin thereof. The bore also includes a beveled area 86 which allows the countersinking of devices which are received in the bore, which will be described later herein.

A lateral perimeter 88 extends about the periphery of node 70 between the exterior and interior surfaces. Node-interlock means, shown generally at 90, are provided about the lateral perimeter of each node and interlock with like means located on adjacent nodes when the frame is in a collapsed condition, or when multiple frames are joined into a single display. In the preferred embodiment, interlock means includes a series of protrusions, such as protrusions 92 which extend outward beyond the perimeter of the node. The protrusions are conformal with, and nestable in, detents such as detents 94 which are located on adjacent nodes. When a frame is in a collapsed condition, the protrusions on one node nest in the detents in an adjacent node to prevent shifting of the nodes relative to one another. This construction provides for a rigid structure which is easily packed and shipped.

Referring now to FIG. 3, an end-hinge receiver 96 is depicted on the exterior surface of the node. Receiver 96 includes, in the preferred embodiment, four flanges 98 which extend normally to exterior surface 78. Each flange has a pair of bores 100, 102 therein, whose purpose will be described later herein.

Referring now to FIG. 4, each node includes pivot means, shown generally at 104, which are used to secure the arms of the box units to the nodes and to allow collapsing of the frame to a compact, or collapsed, condition. Pivot means includes plural receptacles, such as receptacles 106, 108, 110 and 112, which are arranged in a generally cruciform shape, offset across the adjacent axis (72 or 74) on opposed sides of the node. Each receptacle, and now referring to receptacle 106, includes a pair of opposed, spaced apart walls 114, 116 which extend parallel to a node axis, and a base 118 adjacent the center of the node. A node pin 120 is provided to secure an arm to the node and is received in a bore 122 in exterior wall 116 and screws into a stepped bore 124 on interior wall 114. Node pin 120 spans the space between receptacle walls 114, 116. Receptacles 106–112 are arranged about a central region, shown generally at 126 which includes bore 82 therein.

Figure 2:
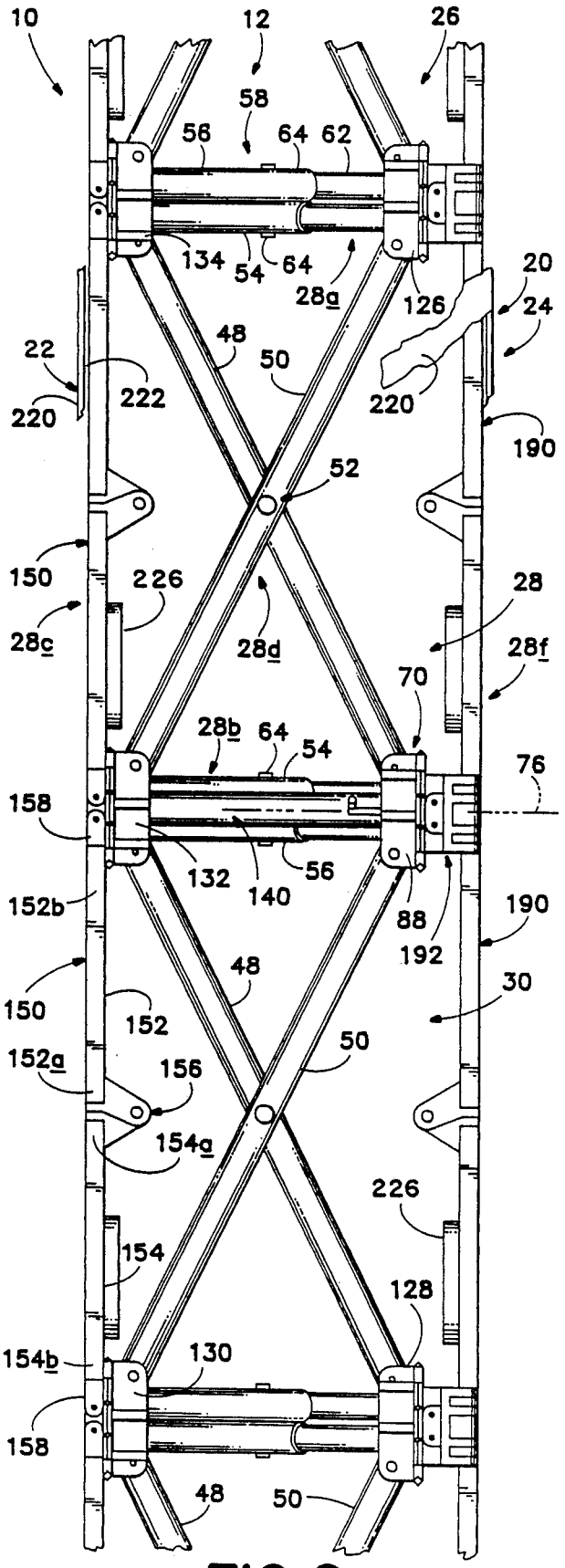
FIG. 2 is a partial side elevation of the display system, taken generally along the line 2—2 of FIG. 1.
Figure 5:
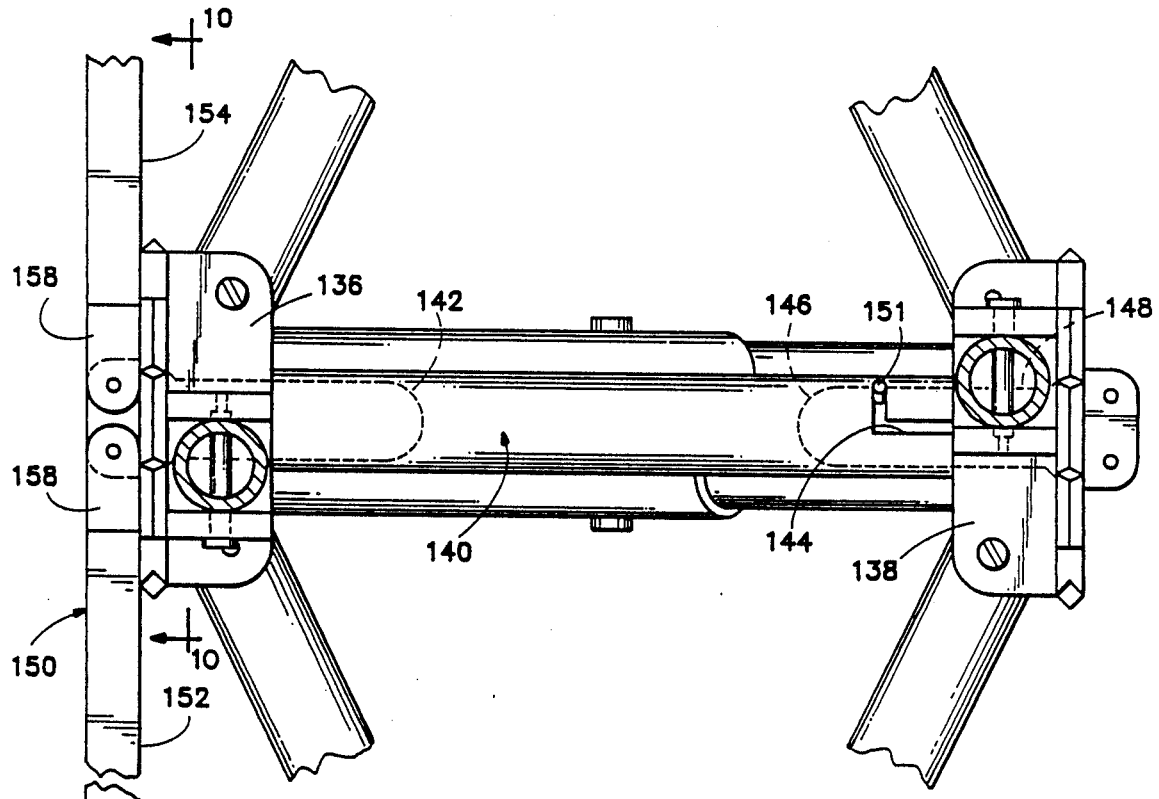
FIG. 5 is an enlarged, interior side view of the frame of the invention, with portions broken away to show detail.

Referring now to FIGS. 2 and 5, additional connector-block nodes are depicted at 126, 128, 130, 132, 134, 136 and 138. A connection rod 140 extends between selected, front and rear face opposing connector-block nodes, such as nodes 70 and 132 in FIG. 2 and nodes 136, 138 in FIG. 5. Connection rods 140 are operable to maintain a predetermined, spaced distance between opposing nodes in the front and rear face of the frame, thereby maintaining the frame in an expanded condition.

Connection rods 140 are rotatably secured to the interior side of a connector-block node on one face of the frame and are detachably secured to the interior side of a connector-block node on the other face. Such securing is accomplished by means of a connection-rod pin, such as pin 142, which is received in bore 82 of node 136, and is rotatable therein. Connection rod 140 has a hollow interior and is fictionally fixed on connection-rod pin 142.

The other end of connection rod 140 has a key way 144 therein and is installable over a connection-rod fastener 146, which is received in bore 82 of node 138. Fastener 146 has a dog 148 which interlocks with notch 84 in node 138, preventing rotation of fastener 146. A key 150 is provided on fastener 146 and is receivable in key way 144 to secure connection rod 140 to connection rod fastener 146. Fastener 146 includes detachable-fastener means for receiving connection rod 140 thereon.

Figure 10:
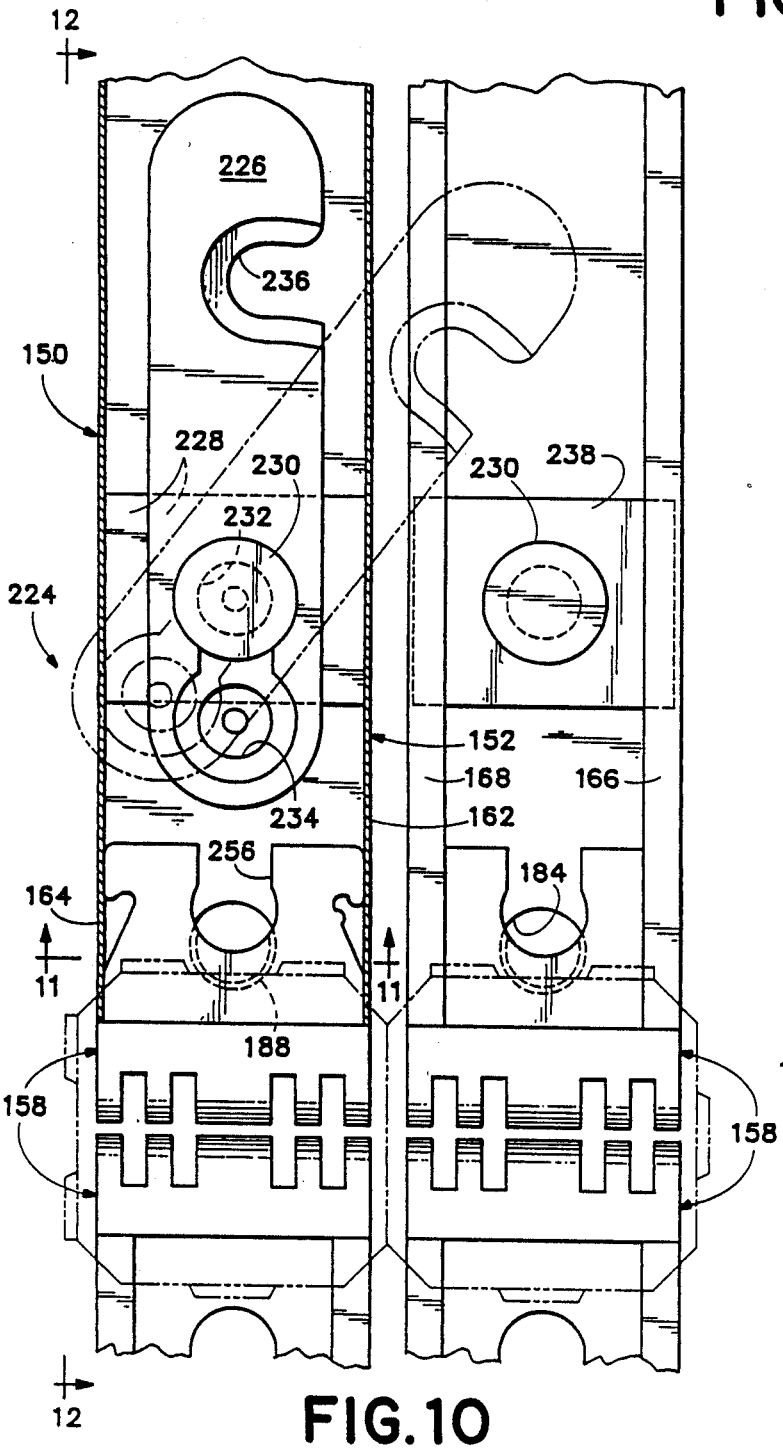
FIG. 10 is a rear-plan elevation of a portion of a display support showing a frame interlocking mechanism of the invention.
Figure 12:
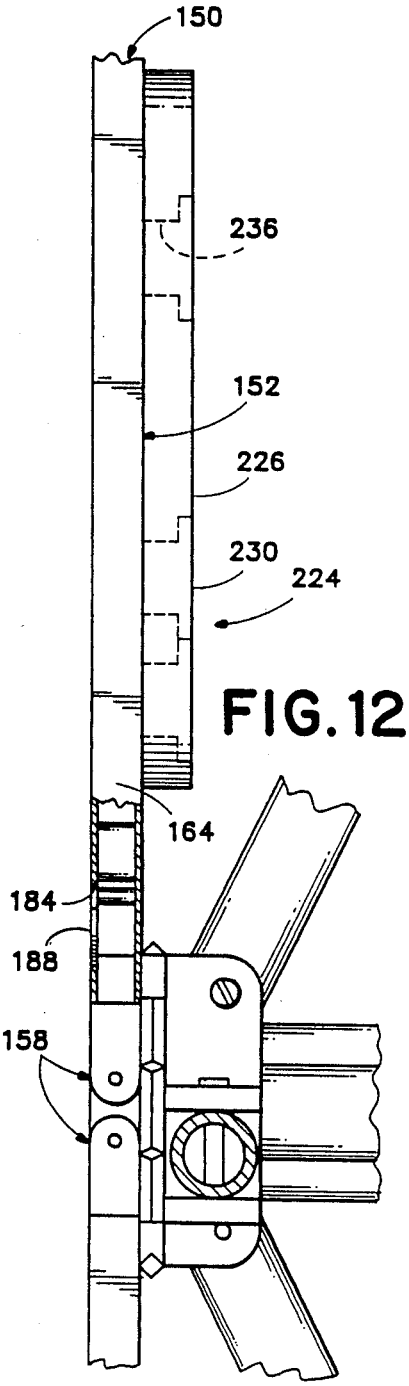
FIG. 12 is a partial side elevation of the frame interlocking mechanism, taken generally along the line 12—12 of FIG. 10.

Referring now to FIGS. 2, 5 and 10, a display support, or strut, of the invention is depicted generally at 150. Referring momentarily to FIG. 1, it may be seen that plural display supports extend along files of connector-block nodes on the front face of the frame. The display supports are flexibly attached to the connector-block nodes and are intended to remain so attached.

Each support extends between adjacent connector-block nodes, such as nodes 130, 132 in FIG. 2, and includes a pair of display support runners 152, 154, which are joined to each other at one, central end, **152*a*, 154*a* by a central hinge 156. The other ends 152*a*, 154*b* are joined to end-hinge receivers 96 on the nodes by an end hinge 158**.

Figure 11:
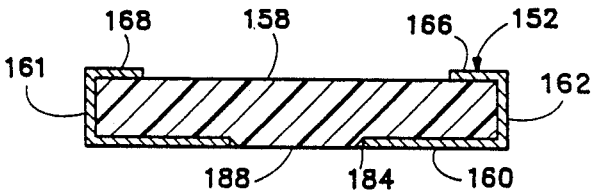
FIG. 11 is a section through a display support, taken generally along line 11—11 of FIG. 10.

Referring now to FIGS. 5, 10 and 11, the display supports and associated structures will be described in more detail. The display support runners, and now referring to FIG. have a substantially C-shaped cross section and include a strap portion 160, sides 162, 164, which are arranged perpendicularly to the strap portion and, opposed, spaced apart flange portions 166, 168 which extend along the length of the runner and are substantially parallel to the strap portion and normal to the sides.

Center hinge 156, now referring to FIG. 5, is constructed to allow outward folding of the display supports from the front face of the frame when the frame is collapsed. Each central hinge includes a first hinge portion 170, a second hinge portion 172, and a hinge pin 174. Portions 170 and 172 are of identical construction and include a first element 176 which is designed to be received in a display support runner, and a second element 178 which extends substantially perpendicularly to the first element and which includes plural flanges across the width thereof, similarly to those of the end-hinge receiver.

An abutting face 180 is located on second element 178 and is constructed so that the runners, received on first elements 176 will be aligned to a straight condition when the hinge is in its fully opened condition, as depicted in FIG. 5. The abutting faces on each central hinge portion are conformal with one another, as are the flanges on the second element of each central hinge portion.

Runners 152, 154 each have an opening 182, 184 which align with and receive protrusions 186, 188 which are located on the central hinge portions and the end hinges, respectively. Protrusions 186, 188 extend through openings 182, 184 in order to hold the central hinge element and end hinge element in place in the runner.

With the frame in an expanded, open, condition, display supports 150 form a continuous, flat support down a file of nodes. If the frame is in a straight-line configuration, the display supports align in a planar configuration across front face 22 of the frame. If the frame is in a curved configuration, the display supports form lines which are part of a smooth curve, extending across the front face of the frame.

Figure 7:
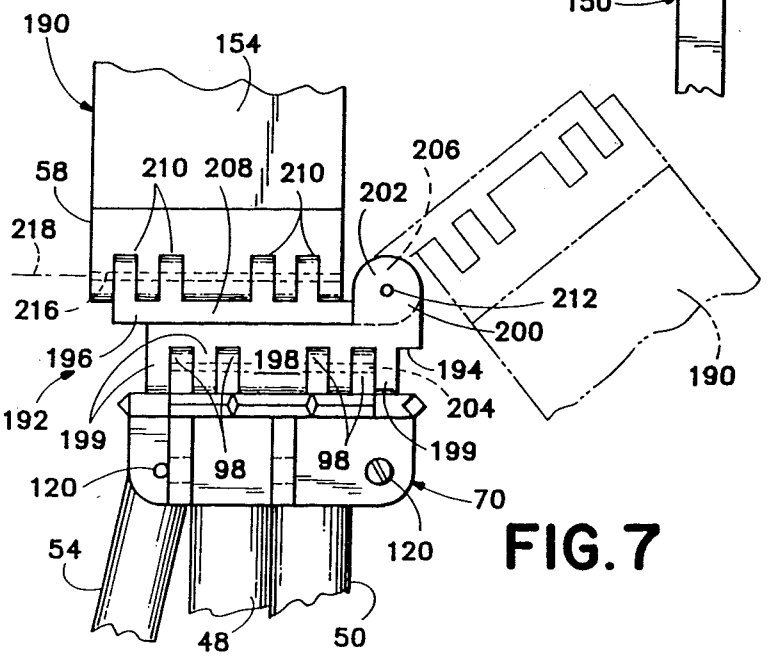
FIG. 7 is an enlarged top-plan view of a two-axis hinge of the invention.

Referring now to FIG. 2, display supports 190 are attached to the connection nodes at either end, on the sides, of frame 12 on the rear face 24 thereof. Display supports 190 are constructed identically to display supports 150, however, they are attached to the nodes by means of a two-axis hinge 192. Referring now to FIG. 7, hinge 192 will be described in greater detail. Two-axis hinge 192 includes a first two-axis element 194 and a second two-axis element 196.

First two-axis element 194 includes a conformal coupling portion 198 which is conformal with and receivable in end-hinge receiver flanges 98. A two-axis receiver portion 200 includes plural hinge flanges 202 which extend laterally outward from coupling portion 198. Coupling portion 198 includes flanges 199 which mesh with flanges 98. First axis element 194 is secured to node 70 by means of pins 204 which pass through bores 100, 102 in flanges 98 and through similar bores in flanges 199.

Second two-axis element 196 has a coupler 206 which has flanges 208 which are conformal with and receivable in two-axis receiver portion 200 hinge flanges 202. An end-hinge receiver portion 208 includes plural flanges 210, which are constructed similarly to flanges 98, to receive an end hinge 158 therein. As depicted in FIG. 7, the frame is in a collapsed condition, with display support 190 extending outwardly from the rear face of frame 12. As shown in the phantom lines in FIG. 7, display support 190 has been partially folded along side of the collapsed frame.

Figure 8:
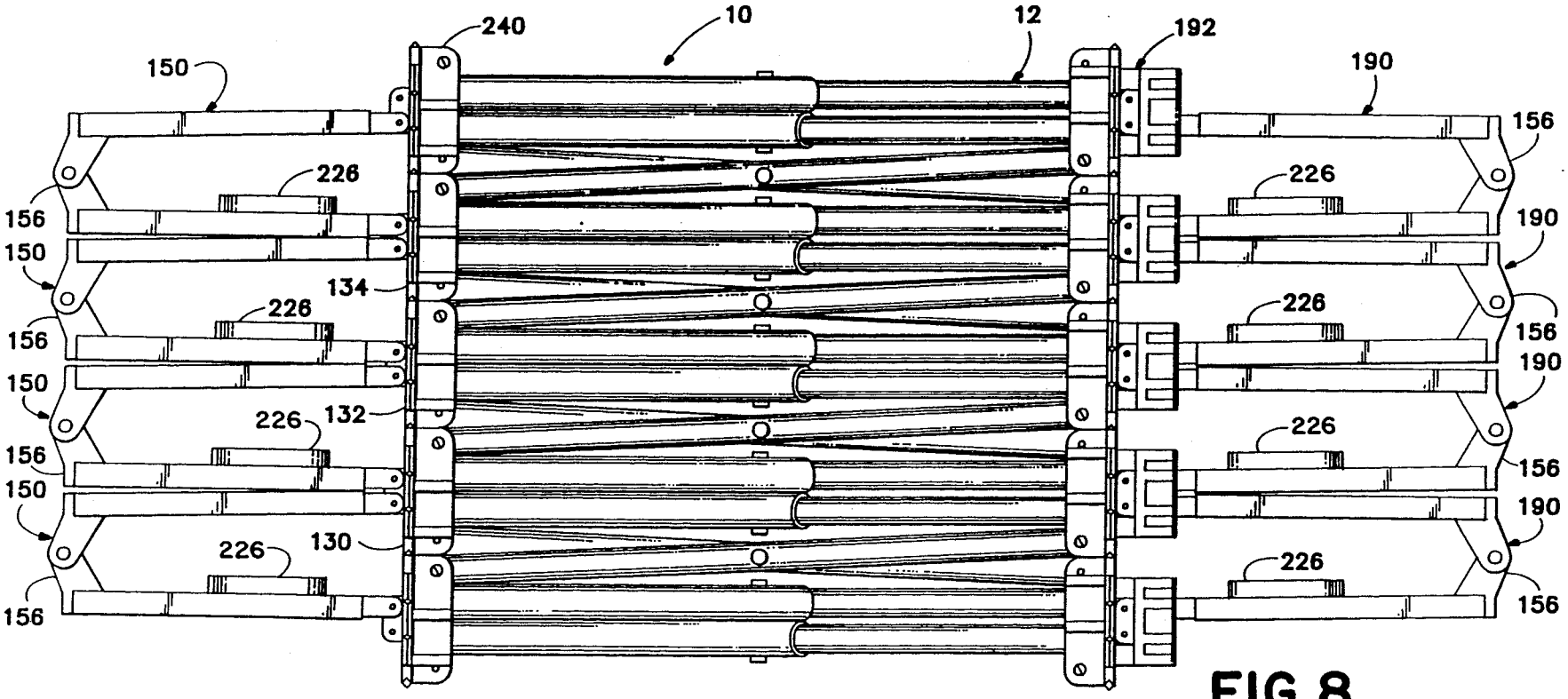
FIG. 8 is a side elevation of the display system in a collapsed condition.

To complete the description of hinge 192, first two-axis element 194 is secured to node 70 in a relatively stationery condition by pins 204. Second two-axis element 196 is rotatably fixed to the first element by a hinge pin 212 which extends along a first axis 214. End hinge 158 is attached to the second two-axis element by a second pin 216 which extends along a second axis 218, which is normal to the first axis. This arrangement provides that the display supports on the rear face of the frame, when the frame is in a collapsed condition, expand outwardly from the rear face of the frame and may be folded along side of the collapsed frame to further compact the system. Referring now to FIG. 8, the frame is shown from the same observed position as FIG. 2, in a collapsed condition. Display supports 150 and 190 are shown extending outwardly from the front and rear faces, respectively, of the frame. Additionally, the interlocking of node interlock means 90 may be observed as protrusions 92 nest in detents 94, thereby holding the nodes relative to one another when the frame is in a collapsed condition.

Figure 9:
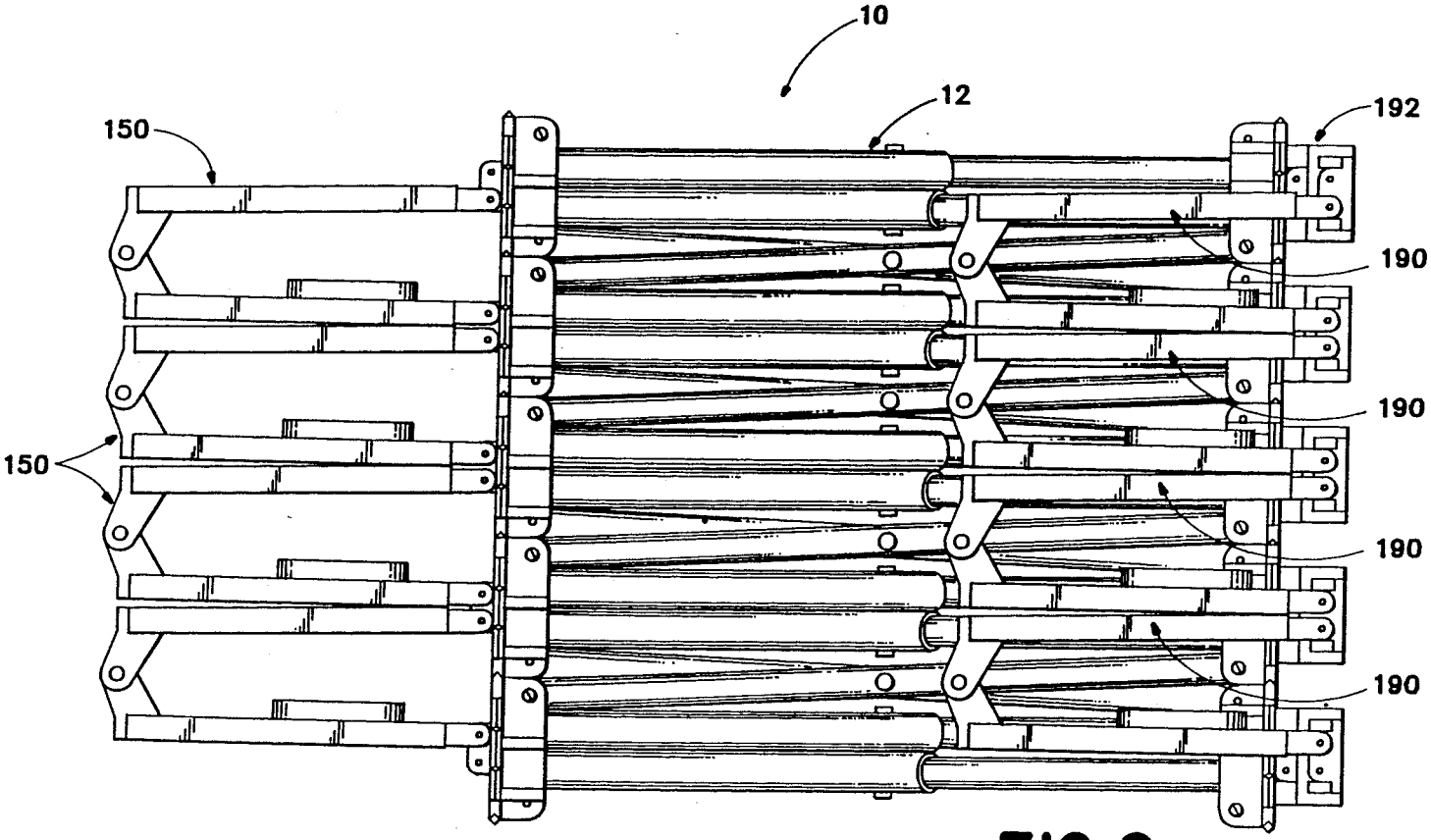
FIG. 9 is a side elevation of the display system in a collapsed condition with the rear display supports folded along side the frame.

Turning now to FIG. 9, rear display supports 190 are shown folded along side of frame 12. In this condition, the frame may be placed upright on two-axis hinges 192, which are capable of supporting the weight of the frame. This is deemed to be more convenient for transporting than requiring that the frame rest on its top, bottom, or either side. Thus, the two-axis hinges of the invention provide a protective device for the rear display supports by allowing the supports to be folded alog side of the display for transportation.

Referring now to FIG. 2, another component of the display system is a web, 220 which is attached to display supports 150, across the front face of the frame, and extends around the sides of the frame to the rear display supports 190. The web may be attached to the display support runners by a variety of attachment means. In the preferred embodiment, attachment means includes magnets 222, which are secured to web 220 in predetermined locations to align with display support runner straps 160. As the runners are made from a ferrous metal material, the magnets will attach to the runners, thereby holding the web in place. A portion of the web is trained around the ends of the display and secured to the runners of display supports 190 for cosmetic reasons, to provide a more finished appearance to the display.

Referring now to FIGS. 10 and 11, frame interlock means of the invention is shown generally at 224. Frame interlock means are located on the display support runners at the ends of a frame. Interlock means include a latch, or latch means 226 which is pivotably mounted on a latch carrier 228, which is received in a display support runner. A latch pin 230 extends through a bore 232 in latch 226 and provides a mechanism for allowing latch 226 to pivot on carrier 228. A second bore 234 is provided in latch 226 in the event that it is necessary to provide more distance between runners on adjacent frames.

Latch 226 has a notch 236 which cooperates with a latch pin 230, which is received on a latch pin carrier 238 on a second runner. As shown in FIG. 10, when latch 226 is secured across latch pins on adjacent runners, two frames are held together such that the node interlock means on one frame cooperates with the node-interlock means on another frame to provide a stable structure. On any given frame, the display supports at one end of the frame are equipped with latches and latch carriers while the supports at the other end of the frame are equipped with latch pins and latch pin carriers.

Figure 13:
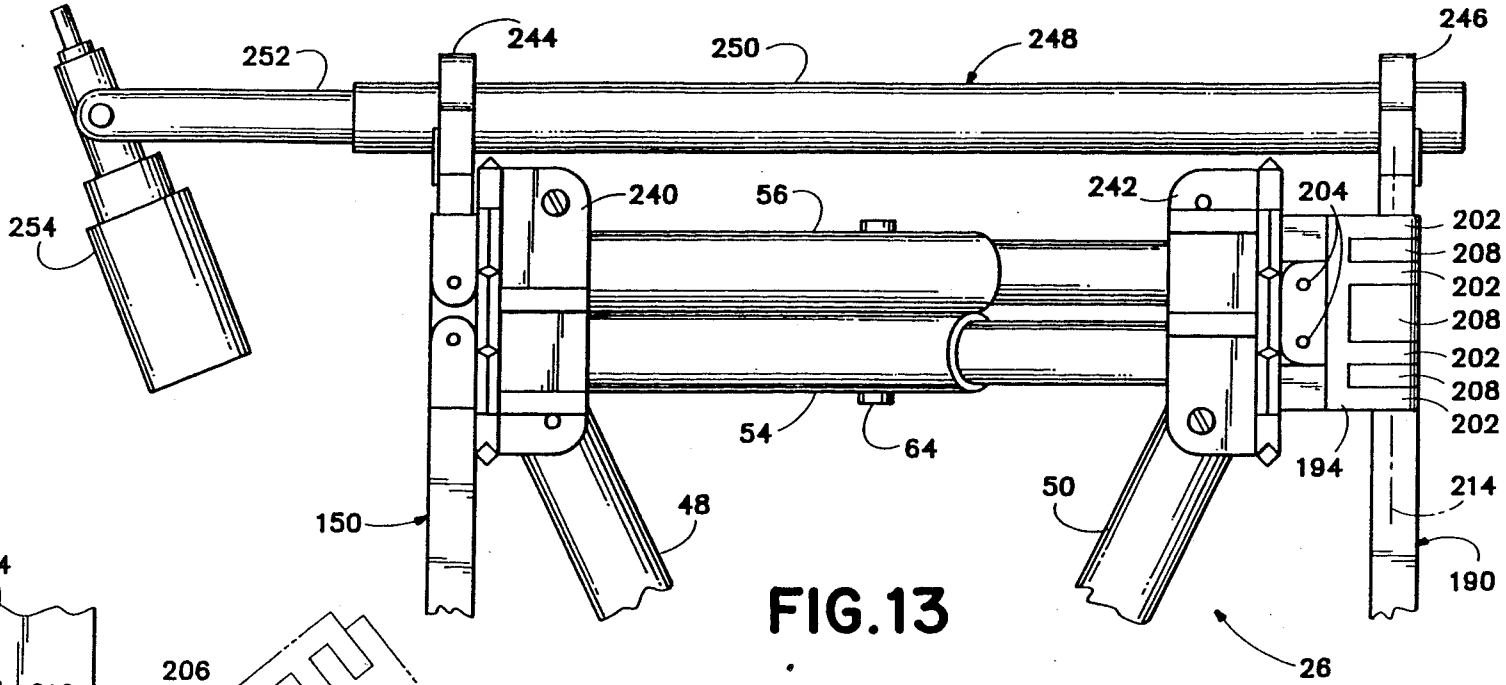
FIG. 13 is a partial side elevation of the display system showing an accessory attachment mechanism.

Turning now to FIGS. 10 and 13, another feature of the end hinges will be described. In FIG. 13, box unit 26 is partially displayed, along with nodes 240 and 242. Two end hinges 244 and 246 are fixed to nodes 240, 242, respectively. An accessory pole 248, having a first part 250, a second part 252 telescopically received therein, and an accessory, such as lamp 254. Accessory pole 248 is received and retained in a slot 256 located in each end hinge, which slot is best depicted in FIG. 10. Pole 248 may be used to support any number od devices, such as projection screens, hanging displays, etc.

Thus, a display system has been disclosed which provides a smooth display surface, may be formed in a curved configuration, and may be easily collapsed for shipping. Although a preferred embodiment of the invention has been disclosed, it should be appreciated that variations and modifications may be made thereto without departing from the scope of the invention, as defined in the appended claims.

I claim:

1. A portable display system comprising:

a collapsible rectangular frame, having a top, a bottom, opposed, spaced apart sides, and a front face and a rear face, including a plurality of rectangular box units, each unit having a top side, bottom side, right side, left side, forward face and rearward face, wherein said top side, bottom side, right side and left side may be shared with adjoining box units, said top side, bottom side, right side and left side each being defined by a pair of arms, the arms in each pair being joined to one another by a scissor connection intermediate their ends, said top side arms and said bottom side arms further including a telescoping member in at least one of said arms of an arm pair; and connector block nodes located at each corner of said box units, each of said nodes including pivot means for securing said arms thereto and for allowing collapsing of said frame to a compact form; and plural display supports extending along files of connector block nodes on the front face of said frame, each support extending between adjacent connector block nodes and including a pair of display-support runners, said runners being joined to one another at one, central end thereof by a central hinge, and joined to a connector block node at the other end thereof by an end hinge.

2. The system of claim 1 wherein each of said nodes includes perpendicular node axes and said pivot means includes plural receptacles arranged in a generally cruciform shape, offset across the adjoining axis on opposing sides of said node, each receptacle including a pair of opposed, spaced-apart walls extending parallel to a node axis, and having a base adjacent the center of said node, and a node pin spanning the space between said receptacle walls.

3. The system of claim 2 wherein said receptacles are arranged about a central region, said region having a bore extending therethrough, said bore having an axis perpendicular to said node axes.

4. The system of claim 3 wherein said node has an exterior surface, facing outward from said frame, and an interior surface, facing toward the interior of said frame, said exterior surfacing having an end-hinge receiver thereon for receiving said end hinges therein.

5. The system of claim 4 which includes, on the rear face of said frame, on the sides only, a file of display supports which are connected, at their other ends, to said node units by a two-axis hinge.

6. The system of claims 1 or 5 further comprising web means and wherein said display supports include attachment means thereon for securing said web means to said frame.

7. The system of claim 6 wherein said attachment means includes magnet means to secure said web means to said display supports.

8. The system of claim 3 which further includes, on selected, front and rear face opposing connector block nodes, connection rods which are rotatably secured to the interior side of a connector block node on one face and which is detachably secured to the interior side of a connector block node of the other face.

9. The system of claim 8 wherein a connection rod pin is received in said connector block node bore on one face of the frame and said connection rod is frictionally fixed on said connection rod pin, and a connection rod fastener is rotatably fixed in said connection rod bore on the other face of the frame and includes detachable fastener means for said connection rod.

10. The system of claim 9 wherein said connection rod other end has a keyway formed in a side thereof and said connection rod fastener has a key thereon receivable in said keyway to secure said connection rod to said connection rod fastener.

11. A portable display system comprising:

a collapsible rectangular frame, having a top, a bottom, opposed, spaced apart sides, and a front face and a rear face, including a plurality of rectangular box units, each unit having a top side, bottom side, right side, left side, forward face and rearward face, wherein said top side, bottom side, right side and left said may be shared with adjoining box units, said top side, bottom side, right side and left said each being defined by a pair of arms, the arms in each pair being joined to one another by a scissor connection intermediate their ends, said top side arms and said bottom side arms further including a telescoping member in at least one of said arms of an arm pair;

connector block nodes located at each corner of said box units, each of said nodes including a bore therein, pivot means for securing said arms thereto and for allowing collapsing of said frame to a compact form, and wherein each node has an exterior surface, facing outward from said frame, an interior surface, facing toward the interior of same frame, said exterior surface having an end-hinge receiver thereon including plural flanges extending outwardly from said node exterior surface; and plural display supports extending along files of connector block nodes on the front face of said frame, each support extending between adjacent connector block nodes and including a pair of display-support runners, said runners being joined to one another at one, central end thereof by a central hinge, and joined to said end-hinge receiver at the other end thereof by an end hinge.

12. The system of claim 11 wherein said runners are elongate and have a substantially C-shaped cross section, including a strap portion, sides which are arranged perpendicularly to said strap portion, and opposed, spaced apart flange portions extending along the length of said runners, substantially parallel to said strap portion, and said central hinge and said end hinges are constructed and arranged to provide outward folding of said display supports from the front face of said frame when said frame is collapsed.

13. The system of claim 12 wherein said runners have an opening in said strap portion adjacent each end of said runner, said end and central hinges have elements which are received within the cross section of said runners, and said elements each have a protrusion thereon which extends through said opening to retain said elements in place.

14. The system of claim 13 wherein said central hinge includes a first hinge portion received on a first runner, and a second hinge portion received on a second runner, each central hinge portion includes a first element which is received in said runner and a second element which extends substantially perpendicularly to said first element and which includes an abutting face thereon which contacts a conformal face on a second hinge element on another hinge portion, such that the runners attached to said hinge portions will be aligned in a straight condition between adjacent connector block nodes.

15. The system of claim 14 which includes, on the rear face of said frame, on the sides only, a file of display supports which are connected, at their ends, to said nodes by a two-axis hinge.

16. The system of claim 15 wherein said two-axis hinge includes a first two-axis element which has a conformal coupling portion, which is conformal with and receivable in said end hinge receiver on a node, and a two-axis receiver portion, which includes plural hinge-flanges, extending laterally outwardly from said coupling portion, and a second two-axis element which has a coupler, which is conformal with and receivable in said two-axis receiver portion, and an end-hinge receiver which is constructed and arranged to receive an end hinge therein, said first two-axis element being relatively stationarily fixed to said node, said second two-axis element being rotatably fixed to said first two-axis element by a pin extending along a first axis in said conformal coupling portion, and wherein an end hinge is attached to said second two-axis element by a second pin extending along a second axis, which is perpendicular to said first axis, such that said display supports on the rear face of said frame, with the frame in a collapsed condition, extend outwardly from said rear face of said frame and are foldable along side of the collapsed frame to further compact the system.

17. The system of claims 11 or 15 further comprising web means and wherein said display supports include attachment means thereon for securing said web means to said frame.

18. The system of claim 17 wherein said attachment means includes magnet means to secure said web means to said display supports.

19. The system of claim 11 wherein each of said nodes includes a lateral perimeter extending between said exterior and interior surfaces, perpendicular node axes and said pivot means which further includes plural receptacles arranged in a generally cruciform shape, offset across the adjoining axis on opening sides of said nodes, each receptacle including a pair of opposed, spaced-apart walls extending parallel to a node axis, and having a base adjacent the center of said node, a node pin spanning the space between said receptacle walls to secure an arm to said node, and wherein each node has, about the lateral perimeter thereof, node interlock means for interlocking with like means on adjacent nodes when said frame is in a collapsed condition to prevent shifting of said nodes relative to one another.

20. The system of claim 19 wherein said interlock means includes a protrusion on one node which is conformal with and nestable in a detent in an adjacent node with said frame in a collapsed condition.

21. The system of claim 20 which further includes frame-interlock means located on the runners at the ends of a frame, said frame interlock means including latch means located on a runner at one end of the frame and catch means for securing said latch means thereto located on a runner at the other end of the frame, said frame-interlock means providing a mechanism for securing plural frames together such that the node-interlock means one frame cooperate with the node-interlock means on another frame to provide a stable structure.

22. The system of claim 11 which further includes, on selected, front and rear face opposing connector block nodes, connection rods which are rotatably secured to the interior side of a connector block node on one face and which is detachably secured to the interior side of a connector block node of the other face 23. The system of claim 22 wherein said connection rod has a hollow interior and wherein a connection-rod pin is received in a connector-block-node bore on one face of the frame and one end of said connection rod is frictionally fixed on said connection-rod pin, and a connection-rod fastener is fixed in said connector block node bore on the other face of the frame and includes detachable fastener means for receiving said connection rod thereon.

24. The system of claim 23 wherein said connection rod's other end has a keyway formed in a side thereof and said connection rod fastener has a key thereon receivable in said keyway to secure said connection rod to said connection-rod fastener.

* * * * *